US011905051B2

(12) United States Patent
Riedmann

(10) Patent No.: US 11,905,051 B2
(45) Date of Patent: Feb. 20, 2024

(54) LOADING DEVICE AND METHOD FOR LOADING STORAGE AND TRANSPORT CONTAINERS WITH PLASTIC RECEPTACLES

(71) Applicant: ALPLA Werke Alwin Lehner GmbH & Co. KG, Hard (AT)

(72) Inventor: Jürgen Riedmann, Höchst (AT)

(73) Assignee: ALPHA WERKE ALWIN LEHNER GMBH & CO. KG, Hard (AT)

( * ) Notice: Subject to any disclaimer, the term of this patent is extended or adjusted under 35 U.S.C. 154(b) by 451 days.

(21) Appl. No.: 16/151,763

(22) Filed: Oct. 4, 2018

(65) Prior Publication Data

US 2019/0031378 A1 Jan. 31, 2019

Related U.S. Application Data

(63) Continuation of application No. PCT/EP2017/057454, filed on Mar. 29, 2017.

(30) Foreign Application Priority Data

Apr. 7, 2016 (CH) ..... 00457/16

(51) Int. Cl.
*B65B 21/06* (2006.01)
*B65B 39/00* (2006.01)
(Continued)

(52) U.S. Cl.
CPC ..... *B65B 21/06* (2013.01); *B65B 5/068* (2013.01); *B65B 5/105* (2013.01); *B65B 5/108* (2013.01);
(Continued)

(58) Field of Classification Search
CPC ..... B65B 5/068; B65B 5/108; B65B 5/105; B65B 21/06; B65B 21/02; B65B 21/12; B65B 39/006; B65B 57/12; B65B 57/14
(Continued)

(56) References Cited

U.S. PATENT DOCUMENTS 6,688,839 B1 * 2/2004 Hirschek ..... B65B 21/06 198/347.1
2003/0136641 A1 7/2003 Iwasa et al.
(Continued)

FOREIGN PATENT DOCUMENTS

EP 0149146 A2 7/1985
EP 2995561 A1 3/2016
(Continued)

OTHER PUBLICATIONS

International Search Report (PCT/ISA/210) dated May 2, 2017, by the European Patent Office as the International Searching Authority for International Application No. PCT/EP2017/057454.
(Continued)

*Primary Examiner* — Valentin Neacsu
*Assistant Examiner* — Mary C Hibbert-Copeland
(74) *Attorney, Agent, or Firm* — BUCHANAN INGERSOLL & ROONEY PC

(57) ABSTRACT

A loading device for loading storage and transport receptacles or trays for plastic receptacles, such as plastic bottles, is disclosed which has a transport system for the trays that can be operated automatically and a transferring device for the plastic receptacles. The transferring device has a multi-gripper for securely grasping a predetermined number of plastic receptacles arranged in the form of a row. A stabilizing system is arranged in a loading station for the trays, which stabilizing system has a first support rack and a second support rack, which are arranged essentially parallel
(Continued)

to one another and can be at least partially inserted into a tray that is to be loaded.

20 Claims, 4 Drawing Sheets

(51) Int. Cl.

| | |
|---|---|
| ***B65B 57/14*** | (2006.01) |
| ***B65B 5/06*** | (2006.01) |
| ***B65B 5/10*** | (2006.01) |
| ***B65B 57/12*** | (2006.01) |
| ***B65B 21/02*** | (2006.01) |
| *B65B 21/12* | (2006.01) |

(52) U.S. Cl.
CPC ..... *B65B 21/02* (2013.01); *B65B 39/006* (2013.01); *B65B 57/12* (2013.01); *B65B 57/14* (2013.01); *B65B 21/12* (2013.01); *B65B 39/007* (2013.01)

(58) Field of Classification Search
USPC ..... 53/448
See application file for complete search history.

(56) References Cited

U.S. PATENT DOCUMENTS

| | | | | |
|---|---|---|---|---|
| 2004/0195074 | A1 | 10/2004 | Iwasa et al. | |
| 2005/0189197 | A1 | 9/2005 | Iwasa et al. | |
| 2005/0229548 | A1 | 10/2005 | Hooper | |
| 2011/0154784 | A1 | 6/2011 | Poutot | |
| 2014/0075891 | A1* | 3/2014 | Hooper | B65B 5/101 53/448 |
| 2016/0059972 | A1* | 3/2016 | Nagata | B65B 43/42 53/446 |

FOREIGN PATENT DOCUMENTS

| | | | |
|---|---|---|---|
| IT | SA20120010 | A1 | 1/2014 |
| JP | H04339705 | A | 11/1992 |
| WO | 9955604 | A1 | 11/1999 |
| WO | 2004000649 | A1 | 12/2003 |
| WO | 2010003083 | A2 | 1/2010 |
| WO | 2012075520 | A1 | 6/2012 |

OTHER PUBLICATIONS

Written Opinion (PCT/ISA/237) dated May 2, 2017, by the European Patent Office as the International Searching Authority for International Application No. PCT/EP2017/057454.

* cited by examiner

LOADING DEVICE AND METHOD FOR LOADING STORAGE AND TRANSPORT CONTAINERS WITH PLASTIC RECEPTACLES

RELATED APPLICATION

This application claims priority as a continuation application under 35 U.S.C. § 120 to PCT/EP2017/057454, which was filed as an International Application on Mar. 29, 2017 designating the U.S., and which claims priority to Swiss Application 00457/16 filed in Switzerland on Apr. 7, 2016. The entire contents of these applications are hereby incorporated by reference in their entireties.

FIELD

The present disclosure relates to a loading device and a method for loading storage and transport containers for plastic receptacles (e.g., plastic containers), such as plastic bottles.

BACKGROUND INFORMATION

The receptacles made of tin, or composite sheet metal, glass or else ceramic, common in the past, are being increasingly replaced by receptacles made of plastic. For the packaging of fluid substances, for example beverages; free-flowing foods such as, ketchup, sugo, pesto, sauces, mustard, mayonnaise and the like; household products; bodily care products; cosmetics, etc., plastic containers are now mainly being used. The low weight and the lower costs certainly play a significant role in this substitution. The use of recyclable plastic materials, the use of bioplastics, and the total energy balance that is more favorable as a whole in their production also contribute to promoting the acceptance of plastic receptacles, such as plastic bottles, by consumers.

After their production in a blow-molding method (extrusion-blow-molding method, stretch-blow-molding method, injection-blow-molding method), empty plastic receptacles are either directly moved on to a dispensing station, or they are loaded into containers in order to be stored intermediately and at a later time to be moved to a site with a dispensing station that can be placed near or away from a manufacturing unit for the production of plastic receptacles. As a result, a capacity of a blow-molding unit can be better used independently of the capacity of a subsequent dispensing unit or the like. In many cases, the plastic receptacles are also produced at production facilities that specialize in the production of such products and are moved from there to a manufacturer of products that are to be dispensed into the plastic receptacles. For their storage and for transport, the plastic receptacles are loaded into storage and transport containers, so-called trays.

The loading of storage and transport containers, the so-called trays, is carried out, for example, in semi- or fully-automatic loading devices for plastic receptacles, which can be components of loading and unloading units and can be arranged connected to a production unit, for example a blow-molding device for plastic receptacles (i.e., containers). In connection with a station for unloading trays, the unit can also be arranged, for example, in front of an aftertreatment unit for plastic containers, for example in front of a dispensing unit. For example, loading devices in which plastic receptacles that are automatically brought in via transport lanes are picked up by a multi-gripper and deposited in rows in a tray are known. In this case, the tray is arranged tilted at a predetermined angle in order to keep the receptacles from falling over after being deposited in the tray. For filling, the multi-gripper must be tilted by the same angle as the tray. If a tray is completely filled, it is moved on, and a new empty tray is moved into the fill position. Because of the increasingly lower weights of the plastic receptacles, for example plastic bottles, it can happen—despite the fact that the tray is inclined—that individual receptacles fall over after they are deposited. This can thus result in interruptions in the loading process, and can involve manual action to maintain operation. Stacking plastic receptacles in layers one on top of the other is not possible with this known loading device.

Another known loading device provides a stationary driven slide on the multi-gripper, which slide pushes together the deposited plastic receptacles on the flat tray bottom. Because of the varying receptacle formats, the use of the slide can prove problematic and can even lead to the plastic receptacles that are deposited in the tray tipping and falling over. In a variant embodiment, the slide can be suspended from the drive and mounted as a fourth side wall on the tray. In this way, the contact of the slide and its guide function relative to the receptacles can be lost, which in turn can result in the deposited plastic receptacles tipping or even falling over. Stacking plastic receptacles one on top of the other is also not possible with this known loading device.

SUMMARY

A loading device is described for loading storage and transport trays for plastic receptacles, the loading device being configured to interact with a transport system for the trays that can be operated automatically and with a transferring device for plastic receptacles, which has a multi-gripper for a number of plastic receptacles that are arranged in a row, the loading device comprising: a stabilizing system arranged in a loading station for trays, which stabilizing system has a first support rack and a second support rack, which are arranged essentially parallel to one another and configured to be at least partially inserted into a tray that is to be loaded, wherein: the second support rack is configured to be adjustable relative to the first support rack from an adjacent first position into a second position with a predefinable distance between the first and second positions, in order to open a first loading lane in a tray that is to be loaded, and the second support rack is arranged such that after the first loading lane has been loaded with plastic receptacles, the second support rack is configured to be movable over the first loaded loading lane opposite to a transport direction (V) of a tray essentially into the first position of the first support rack, wherein moving of the second support rack and the tray in a transport direction (V) of the tray will open a second loading lane that adjoins the first loading lane essentially by a predetermined distance in the first support rack, the first support rack being configured to remain essentially stationary, wherein the second loading lane is configured for approach by a multi-gripper to load at least one second row of plastic receptacles, and wherein the second support rack is configured as an anti-tipping device for a first row of plastic receptacles during the opening of the second loading lane.

A method is disclosed for loading storage and transport trays for plastic receptacles, in which plastic receptacles are loaded into a tray in a loading station by a transferring device that has a multi-gripper, the method comprising: depositing plastic receptacles in a loading lane which is bounded by two side walls of a tray, by a first support rack, and by a second support rack that is arranged essentially parallel to the first support rack, whereby the first and second support racks are inserted at least partially into the tray that is to be loaded; adjusting the second support rack relative to the first support rack from a first position, into a second adjacent position which is a predefinable distance from the first position, in order to open a first loading lane in the tray that is to be loaded; after the first loading lane is filled with a first row of plastic receptacles, moving the second support rack over the first row of plastic receptacles opposite to a transport direction (V) of the tray essentially into the first position of the first support rack; moving the second support rack and the tray in the transport direction (V) of the tray by a predetermined distance to open a second loading lane that adjoins the first loading lane; and moving the multi-gripper toward the second loading lane to load at least one second row of plastic receptacles into the tray whereby the second support rack forms an anti-tipping device for the first row of plastic receptacles during the opening of the second loading lane.

BRIEF DESCRIPTION OF THE DRAWINGS

Other advantages and features of the present invention will follow from the subsequent description of a variant embodiments disclosed herein, with reference to the diagrammatic drawings, which are not depicted true to scale, and in which.

DETAILED DESCRIPTION

Figure 1:
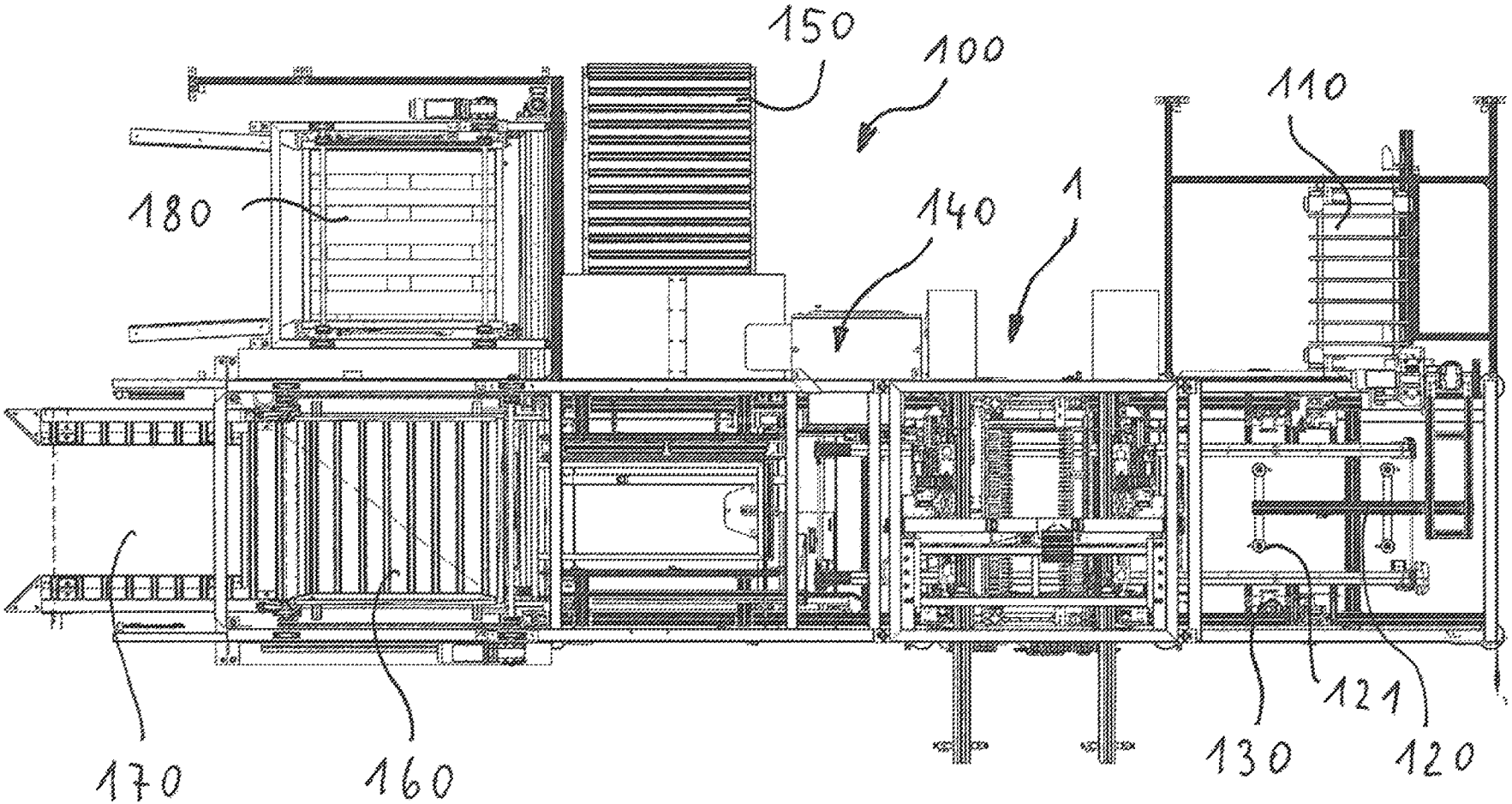
FIG. 1 shows a top view of a loading unit of trays for plastic containers with an exemplary integrated loading device according to the present disclosure.

A loading device for loading storage and transport receptacles or trays for plastic receptacles, such as plastic bottles, is disclosed in which the plastic receptacles are guided during their deposition in a tray. It is possible to keep the deposited plastic receptacles from tipping and falling over. A device and a related method are provided, which even make it possible to stack plastic containers in at least two layers one on top of the other.

A loading device for loading storage and transport receptacles or trays for plastic receptacles, such as plastic bottles, is disclosed which has a transport system for the trays that can be operated automatically and a transferring device for the plastic receptacles. The transferring device has a multi-gripper for securely grasping a predetermined number of plastic receptacles arranged in the form of a row. A stabilizing system is arranged in a loading station for the trays, which stabilizing system has a first support rack and a second support rack, which are arranged essentially parallel to one another and can be at least partially inserted into a tray that is to be loaded. The second support rack can be adjusted relative to the first support rack from an adjacent first position into a second position with a predefinable distance between them, in order to open a first loading lane in the tray that is to be loaded.

After the first loading lane is loaded with plastic receptacles, the second support rack can be moved over the first loaded loading lane opposite to the transport direction of the tray essentially into the first position of the first support rack. By moving the second support rack and the tray in the transport direction of the tray, a second loading lane that adjoins the first loading lane can be opened essentially by a predetermined distance in the essentially stationary first rack. The second loading lane can be approached by the multi-gripper and can be loaded with a second row of plastic receptacles. In this case, the second support rack forms an anti-tipping device for the first row of plastic receptacles during the opening of the second loading lane.

The loading device can have a separate stabilizing system for the plastic receptacles that are loaded into the trays. As a result, it can be ensured that the plastic receptacles are guided and supported as comprehensively as possible during the loading. Tipping and falling over of the plastic receptacles, which could lead to an interruption of the loading process, can thus be prevented.

The provision of a separate stabilizing system in the form of two support racks, which support the plastic receptacles during loading, also creates preconditions for loading the trays with two or more layers of plastic receptacles that are arranged one on top of the other. For loading trays with plastic containers in rows, the latter can be moved into the loading station. For forming the first loading lanes, the first and second support racks can be run into the tray vertically and the second support racks in addition can be run into the tray horizontally. The first loading channel can be formed in the transport direction of the tray adjacent to the front side wall that extends essentially transversally to the transport direction. In the loading channels that are formed between the first and second support racks, the plastic containers that are arranged in rows can be placed via the multi-gripper in the first loading channel.

As an exemplary rule, a tray includes (e.g., consists of) a flat tray bottom and four side walls, which are in general at right angles to one another. The tray can be made square or rectangular. For loading, the tray is open relative to the tray bottom. The tray can be produced from metal, plastic, or cardboard. In most cases, the opening that is opposite to the tray bottom can be closed by a cover.

The width of the loading channel can be selected in such a way that the plastic containers can be inserted into the loading channel, without touching the support racks. The distance of the support racks from the plastic containers can be selected in such a way that the plastic containers cannot tip in the direction of the support racks.

The length of the rows of the plastic containers can be set in such a way that the latter, after insertion into the tray, are supported by the side walls of the tray that extend transversally to the support racks, so that tipping over parallel to the support racks is impossible.

The tray can be conveyed into the loading station, for example, by means for conveying such a two conveyor belts that extend in a parallel manner beside one another. These conveyor belts can be configured for example, as toothed belts, whereby the backs of the toothed belts can be made smooth. Also, carriers can be made on the backs of the toothed belts that keep the tray, when being conveyed, from being conveyed at the speed of the conveyor belt due to its inertia.

After the first loading channel is loaded, the second support rack, which extends parallel to the one side wall and adjoins the latter, can be drawn from the tray essentially perpendicular to the tray bottom without the plastic containers being able to tip over, since they are now supported by said side wall. The second support rack can be moved away in the direction of the first support rack over the first rows of the plastic containers that are located in the tray to the first support rack, which, inserted into the tray, has taken over the support function of the first rows. The second support rack can be inserted into the tray adjoining the first support rack and can thus take over the support function of the first support rack.

To form the second loading lane that adjoins the first loading lane, the tray and the second support rack can now be moved by a predetermined distance in the transport direction of the tray in the case of an essentially stationary first support rack. The moving of the second support rack and the tray can be carried out synchronously.

In exemplary embodiments, a speed of movement of the tray and the second support rack is to be identical, so that during the moving of the tray, the second support rack has essentially no relative movement compared to the tray. When the tray is being moved, the first row of plastic containers can be secured against tipping over by the second support rack. By moving of the tray and the second support rack, a second loading lane that adjoins the first loading lane can be opened relative to the first support rack, which is essentially stationary. Thus, an exclusively vertical movement of the first support rack is adequate for at least partial insertion into the tray when the loading of the tray with the first rows of plastic containers begins and for removal from the tray after the loading of the tray with the last row of plastic containers ends.

After the second loading lane is loaded with a second row of plastic containers via the multi-gripper, the second support rack can again be moved toward the first support rack, and the tray and the second support rack can be moved in the transport direction of the tray in the case of an essentially stationary first support rack for forming a third loading lane. This process of the forming of loading lanes can be repeated until the tray is completely filled with plastic containers and the plastic containers are supported from falling or tipping over by the side walls of the tray.

In another exemplary variant, it is possible to move the tray for loading opposite to the transport direction. Thus, the second support rack can be essentially stationary, and the first support rack can be moved vertically and horizontally. In this variant, the loading speed of the tray can for example, be slowed down relative to the earlier-described embodiment, since the tray to be filled with plastic containers is moved opposite to its transport direction in order to open the loading lanes.

In an exemplary variant embodiment, the support racks have a lateral extension that runs transversally to the transport direction of the tray in order to adjust distance, which extension is configured in such a way that a loading lane is bounded in each case by the first and second support racks and by side walls of the tray that extend in the direction of movement in order to adjust distance. It can thus be ensured that all plastic containers of a deposited row are supported in particular during the opening of a new loading lane and are prevented from tipping or falling over.

Another exemplary variant can provide that the second support rack is configured in an adjustable manner as the anti-tipping device and for opening any loading lane, while the first support rack is stationary during the loading of the tray. The second support rack thus acts as an anti-tipping device for the first row of plastic containers that are loaded in the first loading lane when opening the second loading lane that connects to the first loading lane. In the case of this variant embodiment, after a loading lane is loaded with at least one row of plastic receptacles, first the second support rack is raised vertically, brought in close to the first support rack in the first position, and lowered again. In this case, it can already support the support function of the deposited rows of plastic receptacles. Accordingly, the second support rack and the tray can be moved in the transport direction of the tray relative to the first support rack by a predetermined distance to the opening of a new loading lane. The previously deposited rows of plastic receptacles are in this case reliably prevented from falling over by the second support rack, which now performs the function of the anti-tipping device. In this variant embodiment, the first support rack is essentially inserted vertically into the tray that is to be loaded, and in general, after the loading of the tray with all rows is concluded, a plastic container from the tray is removed essentially vertically from the tray.

In an exemplary variant embodiment, the two support racks can in each case encompass a beam that runs essentially transversally and essentially horizontally to the adjustment direction of the at least one support rack and rack teeth that project vertically therefrom in the direction of a tray bottom. The selected type of configuration can be relatively simple, light, and easy to repair, if multiple rack teeth become bent. Based on the respective outer contour of the plastic receptacles that are provided for loading the trays, the racks can, if necessary or desired, be very easily replaced in order to take into account the altered contour. For example, the individual support racks can be distinguished from one another by the number of rack teeth as well as their width.

An exemplary variant of the device can provide that the rack teeth of the two support racks are offset facing one another and are arranged to cover gaps between teeth. In the assembled state, the rack teeth that cover gaps establish a common support plane. By both support racks being secured to the same support plane, they can be used alternately to support the deposited plastic receptacles. Also, the support function can be taken over especially simply by, for example, the second support rack from the first support rack, since the rack teeth of the second support rack can be inserted into the intermediate spaces that are formed by the rack teeth of the first support rack. Thus, to have the support function be taken over by the second support rack, between the rows of plastic containers to be supported and the rack teeth of the first support rack, there can be no gap into which the rack teeth of the second support rack would otherwise have to be inserted.

An exemplary variant embodiment can provide that the first and the second support racks can move essentially vertically, and at least one of the two support racks can be adjusted essentially horizontally and parallel to the other support rack. The vertical adjustability of the support racks allows a simple vertical insertion and removal of the rack teeth in the tray and a simple adjustment of distance of the two support racks for example to provide for the forming of a loading lane by simple moving of one of the support racks. It is understood that to form the loading lane, the shifting of the second support rack can be carried out essentially horizontally, in such a way that the two support racks are inserted into the tray, parallel to one another, in their end position.

In another exemplary variant embodiment, the rack teeth of the support racks have a vertical length that is greater than a depth of a tray that is to be loaded. As a result, the rack teeth, or the support racks, are wide enough to be insertable into the tray that is to be loaded. As a result, the groundwork can also be laid for loading the tray with two or more rows of plastic receptacles that are arranged one on top of the other. Since the rack teeth can be inserted far enough, shorter plastic receptacles can also be adequately supported. Basically, the rack teeth can be inserted far enough into the tray for at least one part of the rack teeth to touch the tray bottom.

In an exemplary variant embodiment, the entire sequence of movement of the individual components of the device—in particular the transport of trays, the movement of support racks, and the loading of trays by means of the transferring device that comprises a multi-gripper—is carried out in a computer-controlled manner. Computer control can allow a very fast and simple matching of the sequences of movement to various plastic receptacle shapes and/or the sizes of the trays that are to be loaded. In this case, the multi-gripper can be arranged on a transferring robot, which is configured to carry out linear (transverse and vertical) and rotational movements.

The described variant embodiments can, for example, be a component of a semi- or fully-automatic loading and unloading unit for plastic receptacles. Such a unit can have a separating unit for the tray stack, a supply of individual empty trays, a loading station for loading the separated trays with rows of plastic containers, evacuation of the loaded trays, and a feed segment for the plastic receptacles.

In an exemplary method for loading storage and transport receptacles or trays for plastic receptacles, such as plastic bottles, plastic receptacles that are moved up for example in rows are loaded into a tray in a loading station for trays from a transferring device that has a multi-gripper. In this case, the plastic receptacles are in each case deposited in a loading lane, which is bounded by two side walls of the tray and by a first support rack and a second support rack that is arranged essentially parallel to the first support rack. The two support racks are inserted at least partially into the tray that is to be loaded. The second support rack is adjusted relative to the first support rack from a first position, adjacent to one another, into a second position at a predefinable distance, in order to open a first loading lane in the tray that is to be loaded.

After the filling of the first loading lanes with a first row of plastic receptacles, the second support rack is moved over the first row of plastic receptacles opposite to the transport direction of the tray essentially into the first position of the first support rack, whereby by moving the second support rack and the tray in the transport direction of the tray by a predetermined distance, a second loading lane that adjoins the first loading lane is opened, which is approached by the multi-gripper and is loaded with at least one second row of plastic receptacles. The second support rack forms an anti-tipping device for the first row of plastic receptacles during the opening of the second loading lane.

It can be ensured with exemplary methods disclosed herein that the plastic receptacles that are deposited in the respective loading lane via a multi-gripper are comprehensively supported during the loading. Receptacles can thus be kept from tipping or even falling over. With exemplary methods according to the disclosure, plastic receptacles that are deposited in a loading lane remain supported even when a connecting new loading lane is opened.

In an exemplary method variant, each loading lane of rack teeth of the first support rack is bounded by rack teeth of the second support rack and by side walls of the tray that is to be loaded. The rack teeth of the two support racks are offset facing one another and cover gaps between teeth in such a way that the two support racks in the assembled state establish a common support plane.

A process sequence can provide that after the first loading lane is loaded with plastic receptacles, the second support rack is inserted essentially along the support plane into the first support rack, so that it takes over the support function of the first support rack at the first row of loaded plastic receptacles. Process control can provide that after the second support rack is brought close to the first support rack and after the support function is taken over by the second support rack, the latter together with the tray that is to be loaded is moved the predefined distance relative to the first support rack. In this case, the second loading lane is opened. The first support rack is in this case not adjusted.

In an exemplary method variant, the two support racks are adjusted vertically, and at least the second support rack is shifted at least essentially horizontally and parallel to the first support rack. In this way, a loading lane can be formed in a simple way.

In an exemplary method variant, the second support rack in connection with a movement of the tray can be adjusted relative to the first support rack in such a way that in the tray, a loading lane is opened whose width makes possible the one-time deposition of at least one, for example multiple, row(s) of plastic containers that are moved up with the multi-gripper. At the same time, the loading process of a tray can be accelerated directly through the one-time loading with multiple rows.

In an exemplary method variant, two or more layers of plastic receptacles can be deposited sequentially via the multi-gripper one on top of the other in a loading lane that is bounded by the support racks and the side walls of a tray. This method variant is made possible only by the comprehensive and alternating support function of the two support racks, and it allows trays of specified dimensions, also, for example, with plastic receptacles of lower volume or lower overall height, to be loaded.

An exemplary variant can provide that the trays that are made of cardboard are separated before delivery to the loading station in a separation unit from a tray stack of trays that are stacked one on top of the other, in which the side walls are folded-in. In this case, the uppermost tray with the folded-in side walls is removed by means of vacuum grippers from a tray stack that is located in a magazine, which for example is manually filled with tray stacks and delivered to a tray feed unit. The side walls of the tray are folded out in an automated manner. Then, the folded-out tray is moved into a guide, which prevents the side walls from folding in.

The tray is fed to the loading station and filled there with rows of plastic containers as already described. After the filling with plastic containers is completed, the trays can be evacuated and either stacked in an internal stacking station or delivered to a separate stacking station. Trays that are stacked one on top of the other are easier to transport and make possible a space-saving storage facility, for example, in a high-bay warehouse or the like for intermediate storage of plastic receptacles. For this reason, trays that are loaded with plastic receptacles can be recombined to form a tray stack after loading in a stacking station. For reasons of stability, in this case, the individual trays that are manufactured from metal or plastic are combined up to an exemplary maximum stack height of approximately 4,000 mm. The stack height for trays that are manufactured from cardboard for reasons of stability in general does not exceed a stack height of for example approximately 2,800 mm.

In another exemplary variant, for separation, the tray stack—for example, in the case of trays manufactured from plastic or metal—can be raised above the bottom tray. Thus, the bottom tray in the loading station can for example, be transported by means for conveying, such as a roller conveyor. Specifically, the raising of the tray stack saves time compared to removal of the uppermost tray, which then has to be run vertically downward in order to be able to deposit it on the roller conveyor.

In this case, it will be appreciated by those skilled in the art that features of the device and features of the method, if desired, can be combined with one another, in order to achieve desired objects disclosed herein.

With reference to the drawings, a loading unit of storage and transport containers, so-called trays, is provided in FIG. 1, with the overall reference number 100. Such a unit 100 can be arranged, for example, connected to a production unit for plastic receptacles, for example a blow-molding unit that produces plastic bottles. Such loading units 100 can be used for filling trays, manufactured from cardboard, with plastic receptacles, whereby the individual trays are stacked up and are transported into a storage area or into a geographically separate filling unit.

The loading unit 100 of trays includes a tray magazine 110 for trays that are manufactured from cardboard and folded together. The tray magazine 110 can be filled manually. The uppermost tray is removed by means for transfer, such as a tray transfer unit 120, from the tray stack, which unit is equipped with vacuum lifts 121 in this exemplary embodiment and fed to an unfolding unit 130. There, the tray that is folded together is unfolded and fed to a loading device 1.

In the loading device 1, the trays are loaded with, for example, plastic receptacles that are fed in rows. The trays that are loaded with plastic receptacles are transported to an evacuation unit 140. There, the trays are examined as to whether they were loaded properly. Incompletely loaded trays are removed via the output unit 150. Trays that are loaded in an ordinary (e.g., proper/acceptable) fashion are transported to a tray stacking unit 160, in which the loaded trays are stacked up on a pallet. For example, the maximum stack height of 2,800 mm is not exceeded.

In a connecting discharge unit 170, a pallet is removed manually with the tray stack. For example, manually by means for removing such as a lift truck. The pallets can be stored in a pallet magazine 180, if necessary or desired. The transport systems for the trays can be, for example, conveyor belts or roller conveyors.

The loading unit 100 that is depicted in FIG. 1, for example, is built in a linear manner, which in many cases can be advantageous, for example, for reasons of space. In an alternative exemplary variant embodiment, the loading unit 100 can be built L-shaped, or U-shaped or other suitable shape. In this way, the unit can be matched to local conditions.

Figure 2:
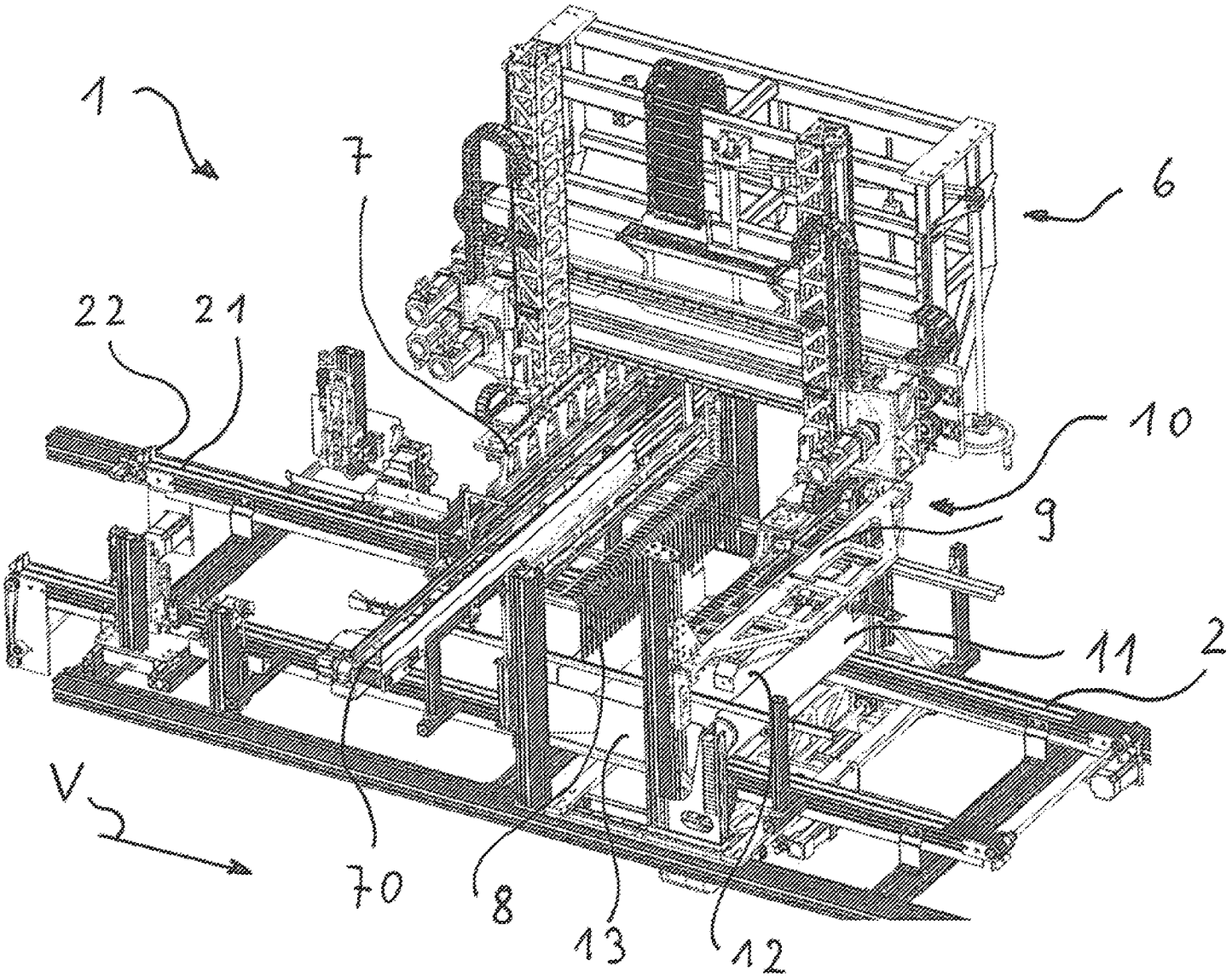
FIG. 2 shows a perspective view of a loading device according to the present disclosure.

FIG. 2 shows a diagrammatic depiction of a loading device that is configured and arranged according to an exemplary embodiment disclosed herein, which device is provided with the overall reference number 1. The loading device 1, which is also referred to for example, as a tray packer, includes a loading station 10 for the trays, a transferring device 6 with a multi-gripper 7, and a transport system 2 for trays, which in this embodiment is configured as a conveyor belt. The conveyor belt 2 is configured for a linear transport and can for example, be moved in a start-stop operation by predetermined distances of any lengths. A belt 21 of the conveyor belt 2 has a transport cam 22 that holds the tray in position on the belt and prevents the tray from sliding on the belt when the conveyor belt 2 starts up.

In FIG. 2, a tray 11 inside the loading station 10 is depicted. The tray 11 has an essentially orthogonal flat tray bottom 12 and an essentially rectangular flat side wall 13. For example, the tray 11 is made square, and exemplary external dimensions are approximately 1,200 mm×1,200 mm. In a rectangular variant embodiment, the tray can have exemplary external dimensions that are, for example, up to 1,400 mm×1,200 mm. The height of a tray is variable and can be, for example, from 50 mm to 400 mm. The transport system 2 for the trays can also be, for example, a roller conveyor.

In the loading station 10, a transferring device 6 is active, which device has a multi-gripper 7 for plastic receptacles that are for example, moved up in rows. The transferring device 6 can be, for example, a transferring robot, which can be configured for linear (transverse, vertical) movements and for rotational movements. The multi-gripper 7 grips the plastic receptacles that are moved up in a conveyor lane 70 in a row and deposits the latter into the tray 11 after a longitudinal shift. The multi-gripper 7 can also be configured for detection of more than one row of plastic receptacles. The multi-gripper 7 can be a vacuum gripper or can have a gripper head, whose mechanical gripper elements are matched exactly to the outside diameter of the openings of the plastic receptacles that are to be transported, or other suitable device. In the case of a format change, the entire gripper head can be easily replaced. A more detailed description of the transferring device 6 and the multi-gripper 7 is not necessary as such systems are sufficiently known from the state of the art.

A first support rack 8 and a second support rack 9 are arranged between the transferring device 6 and the tray 11, which racks are arranged approximately parallel to one another and which are used to support the plastic receptacles that are deposited in the tray 11. The support racks 8, 9 are stored in such a way that the relative distance between them can be adjusted according to specifications. In this case, the adjustment is carried out essentially parallel to a lengthwise extension of the tray 11 that is to be loaded or essentially perpendicular to a direction of movement of the tray 11 into the loading station 10. The support racks 8, 9 and their mode of operation will be explained in more detail.

Figure 3:
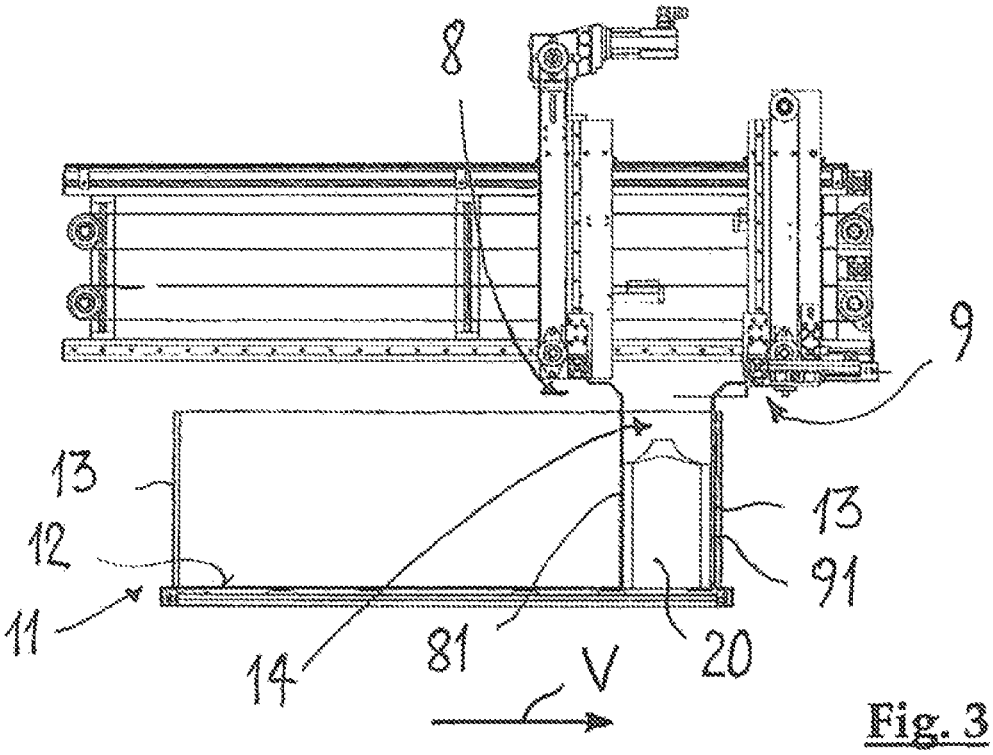
FIG. 3 to FIG. 5 show three side views of exemplary support racks in three different positions.
Figure 5:
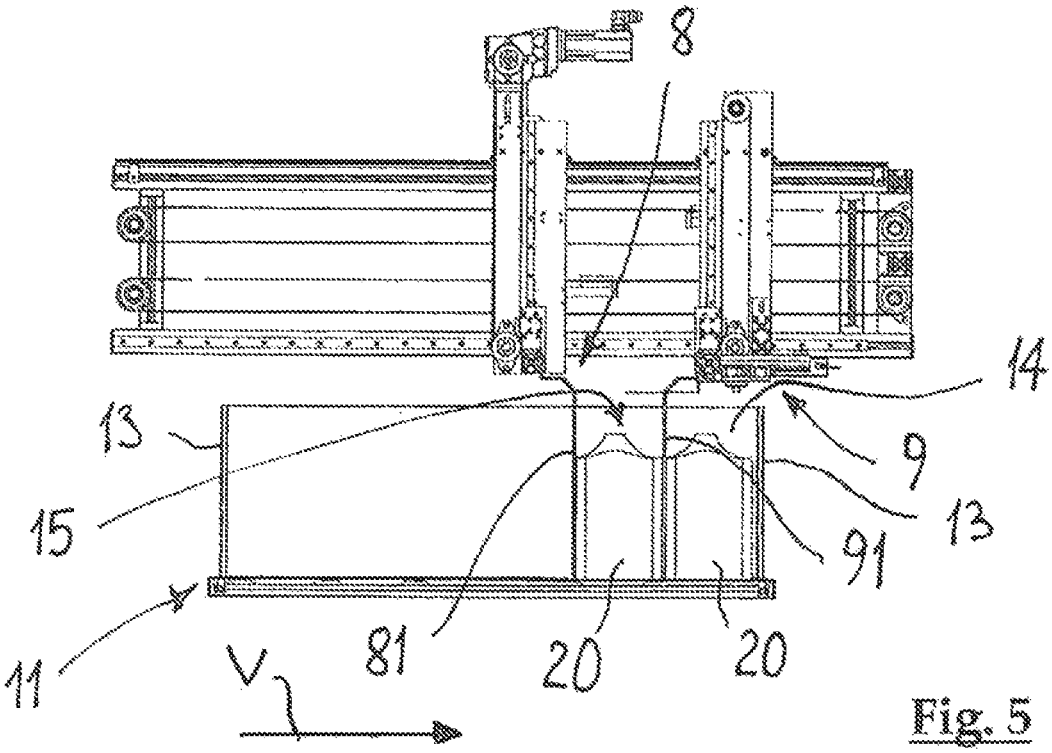
Figure 4:
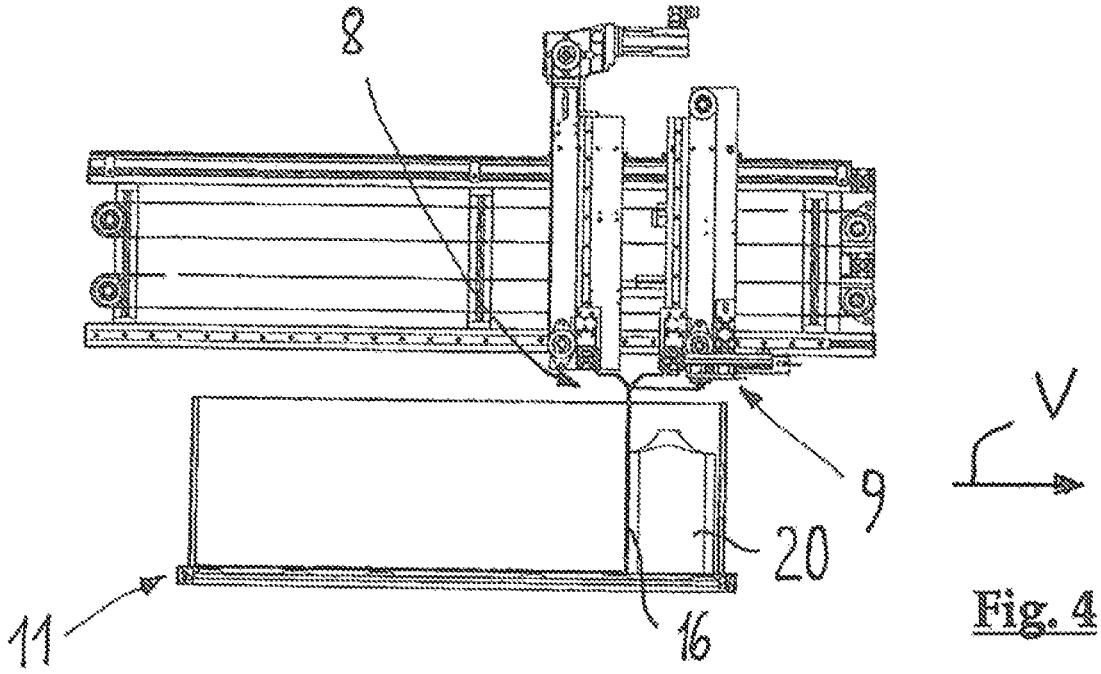
Figure 6:
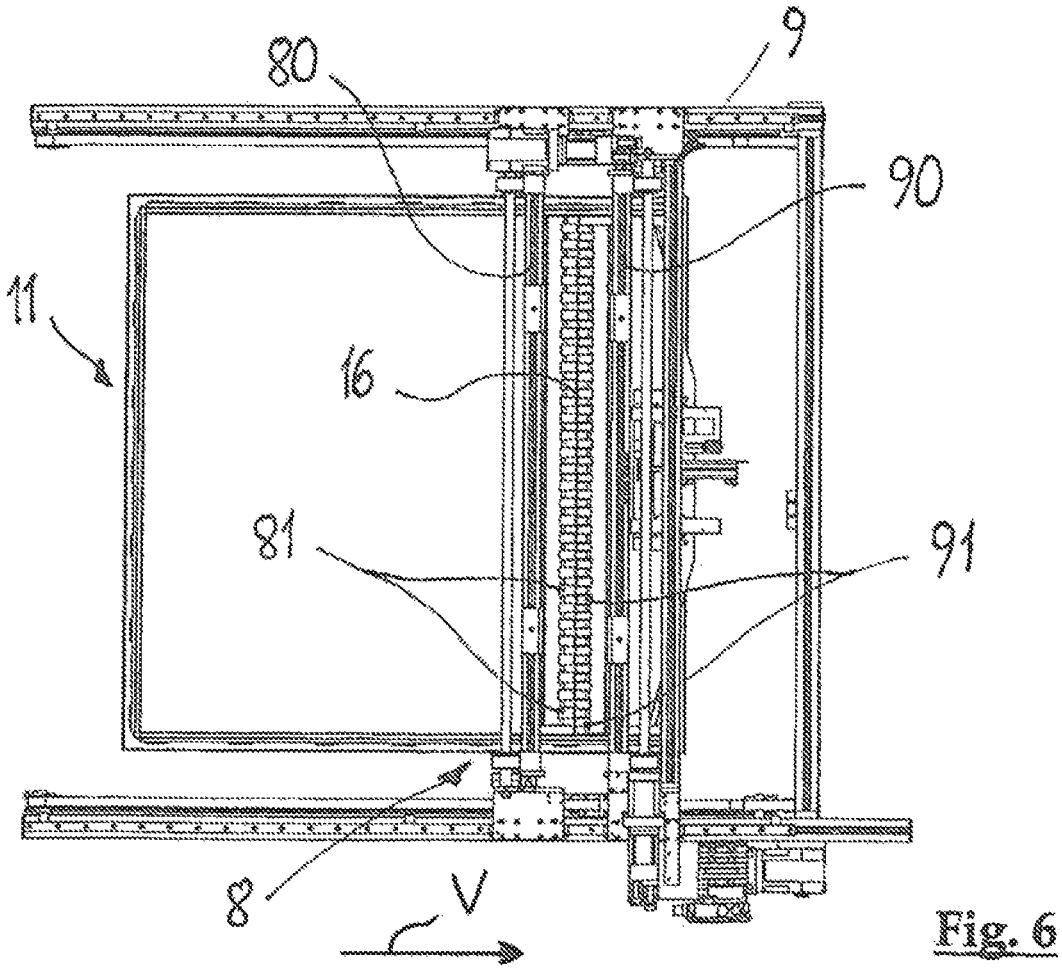
FIG. 6 shows a top view on an exemplary support rack in a pushed-together position.

FIGS. 3 to 5 show the first support rack 8 and the second support rack 9 in various positions. FIG. 6 shows in addition a top view of the two support racks 8, 9 in a pushed-together position according to the side view in FIG. 4. The two support racks 8, 9 in each case have rack teeth 81, 91, which project vertically in a direction of the tray bottom 12 from a beam 80, 90 that runs transversally to the adjustment direction of the support racks 8, 9. The rack teeth 81, 91 are offset facing one another and are arranged on the respective beams 80, 90 in such a way that they cover the gaps (FIG. 6). The rack teeth 81, 91 of the two assembled support racks 8, 9 thus define a common support plane 16 (FIGS. 4 and 6). The length of the rack teeth 81, 91 of the two support racks 8, 9 can be set such that they reach just in front of the tray bottom 12 of a tray 11 that is to be filled but still do not touch the latter.

At the beginning of the loading process of a tray 11 that is arranged in the loading station 10 (FIG. 2), the two support racks 8, 9 are inserted into the tray 11 in such a way that the rack teeth 91 of the second support rack 9 are arranged adjacent to a rear side wall 13 of the tray 11. The first support rack 8 is arranged at a predefinable distance from the second support rack 9 and thus opens a first loading lane 14 in the tray 11 that is to be loaded. In this first loading lane 14, the multi-gripper 7 (FIG. 2) can now deposit at least one row of plastic receptacles 20. In the case of a multi-gripper 7, which can grip several rows of plastic receptacles at the same time, the first support rack 8 and the second support rack 9 are separated from one another in such a way that the first loading lane 14 that is formed by the two support racks 8, 9 has a width that corresponds to the entire width of the rows of plastic receptacles 20 that are arranged beside one another.

After the multi-gripper 7 has deposited the plastic receptacles 20 in the first loading lane 14 and during or after it has been shifted to grip additional plastic receptacles, the second support rack 9 is raised vertically in such a way that the free ends of its rack teeth 91 are arranged above the plastic receptacles 20 that are deposited in the tray 11. Then, the second support rack 9 is brought close to the first support rack 8 opposite to the direction of movement V of the tray 11 and then lowered. The rack teeth 81, 91 cover the gaps and establish a common support plane 16 (FIGS. 4 and 6). Then, the second support rack 9 together with the tray 11 is adjusted in its direction of movement V compared to the first support rack 8 by a predefined distance in order to open a second loading lane 15.

During the opening of the second loading lane 15 that adjoins the first loading lane 14, the second support rack 9 takes over the support function for the deposited plastic receptacles 20 (FIG. 5). The second support rack 9 and the tray 11 have essentially no relative movement to one another during the opening of the second loading lane 15. The newly provided second loading lane 15 is now ready to receive additional plastic receptacles, which are moved up by the multi-gripper 7. The process of the second support rack 9 moving away over the plastic container 20 that has just been deposited in the tray 11 opposite to the direction of movement V of the tray 11, the insertion of the second support rack 9 into the first support rack 8, and the opening of another loading lane by common movement of the second support rack 9 and the tray 11 in the direction of movement V of the tray 11 is repeated until the entire tray 11 is filled with plastic receptacles 20. After the rack teeth 81, 91 extend over the entire height of the tray 11, several layers of plastic receptacles can also be deposited one on top of the other in the loading lanes 14, 15 that are bounded in each case by the two support racks 8, 9 and the side walls 13 of the tray 11 in the case of shorter plastic receptacles. After the tray 11 is filled, the latter can be removed from the loading station 10 (FIG. 2) for further processing.

The operation of the individual components of the device, in particular the transport of the trays 11, the movement of the support racks 8, 9, and the loading of the trays 11 by means of the transferring device that includes a multi-gripper 7, can be carried out by a computer controller in a computer-controlled manner. Computer control allows very fast and simple matching of the sequence of movements to different shapes of the plastic receptacles 20 and/or sizes of the trays 11 that are to be loaded.

The loading device according to the disclosed embodiments can have a separate stabilizing system for the plastic receptacles 20 that are loaded into the trays 11. As a result, it can be ensured that the plastic receptacles 20 are guided and supported as comprehensively as possible during the loading. It is thus possible to keep the plastic receptacles 20 from tipping and falling over, which could lead to an interruption in the loading process. The provision of a separate stabilizing system in the form of two support racks 8, 9, which support the plastic receptacles 20 during the loading, also lays the groundwork for loading the trays 11 with two or more layers of plastic receptacles 20 that are arranged one on top of the other.

The description above of concrete embodiments is used only to explain the invention and is not to be considered as limiting.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. Loading device for loading storage and transport trays for plastic receptacles, the loading device being configured to interact with a transport system for the trays that can be operated automatically and with a transferring device for plastic receptacles, which has a multi-gripper for a number of plastic receptacles that are arranged in a row, the loading device comprising:

a stabilizing system arranged in a loading station for trays, which stabilizing system has a first support rack and a second support rack, which are arranged essentially parallel to one another and configured to be at least partially inserted into a tray that is to be loaded, wherein:

the first support rack being configured to remain essentially stationary during loading of the plastic receptacles, the second support rack is configured to be adjustable relative to the first support rack from an adjacent first position into a second position with a predefinable distance between the first and second positions, in order to open a first loading lane in a tray that is to be loaded, and the second support rack is arranged such that after the first loading lane has been loaded with plastic receptacles, the second support rack is configured to be movable over the first loaded loading lane opposite to a transport direction (V) of a tray essentially into the first position of the first support rack, wherein the second support rack and the tray are configured to be moved in the transport direction (V) of the tray by a predetermined distance to open a second loading lane that adjoins the first loading lane, wherein the second loading lane is configured for approach by a multi-gripper to load at least one second row of plastic receptacles, and wherein the second support rack is configured as an anti-tipping device for a first row of plastic receptacles during the opening of the second loading lane.

2. Device according to claim 1, wherein the support racks comprise:

a lateral extension that runs transversally to the transport direction (V) in order to adjust distance, which extension is configured in such a way that a loading lane will be bounded by the two support racks and by side walls of a tray that extend in a direction of movement in order to adjust distance.

3. Device according to claim 2 wherein the second support rack is configured as the anti-tipping device and is adjustable to open any loading lane, while the first support rack is essentially stationary during the loading of a tray.

4. Device according to claim 3, wherein first and second support racks each include a beam that runs essentially transversally and essentially horizontally to an adjustment direction of the respective first and second support racks, and comprise:

rack teeth that project vertically therefrom in a direction of a tray bottom during operation.

5. Device according to claim 4, wherein the first and second support racks are movable essentially vertically, and at least one of the first and second support racks is adjustable essentially horizontally and parallel to the other support rack.

6. Device according to claim 1 wherein the second support rack is configured as the anti-tipping device and is adjustable to open any loading lane, while the first support rack is essentially stationary during the loading of a tray.

7. Device according to claim 1, wherein first and second support racks each include a beam that runs essentially transversally and essentially horizontally to an adjustment direction of the respective first and second support racks, and comprise:

rack teeth that project vertically therefrom in a direction of a tray bottom during operation.

8. Device according to claim 7, wherein the rack teeth of the first and second support racks are offset facing one another and are arranged to cover gaps between teeth, whereby in an assembled state, they establish a common support plane.

9. Device according to claim 7, wherein the rack teeth of the first and second support racks have a vertical length that is greater than a depth of a tray that is to be loaded.

10. Device according to claim 1, wherein the first and second support racks are movable essentially vertically, and at least one of the first and second support racks is adjustable essentially horizontally and parallel to the other support rack.

11. A combination, comprising the device according to claim 1, and further comprising:

a transport system for the trays and a transferring device having a multi-gripper for plural plastic receptacles; and a computer controller for controlling a transport of trays, movement of the first and second support racks, and loading of trays by the transferring device and its multi-gripper.

12. A combination, comprising the device according to claim 11, and further comprising:

at least one tray configured for transport and for loading of plastic bottles by the multi-gripper.

13. Device according to claim 1, wherein the plastic receptacles are configured as plastic bottles.

14. Method for loading storage and transport trays for plastic receptacles, in which plastic receptacles are loaded into a tray in a loading station by a transferring device that has a multi-gripper, the method comprising:

depositing plastic receptacles in a loading lane which is bounded by two side walls of a tray, by a first support rack, and by a second support rack that is arranged essentially parallel to the first support rack, whereby the first and second support racks are inserted at least partially into the tray that is to be loaded;

maintaining the first support rack essentially stationary during loading of the plastic receptacles;

adjusting the second support rack relative to the first support rack from a first position, into a second adjacent position which is a predefinable distance from the first position, in order to open a first loading lane in the tray that is to be loaded;

after the first loading lane is filled with a first row of plastic receptacles, moving the second support rack over the first row of plastic receptacles opposite to a transport direction (V) of the tray essentially into the first position of the first support rack;

moving the second support rack and the tray in the transport direction (V) of the tray by a predetermined distance to open a second loading lane that adjoins the first loading lane; and moving the multi-gripper toward the second loading lane to load at least one second row of plastic receptacles into the tray whereby the second support rack forms an anti-tipping device for the first row of plastic receptacles during the opening of the second loading lane.

15. Method according to claim 14, wherein each loading lane is bounded by rack teeth of the first support rack, by rack teeth of the second support rack, and by side walls of the tray that is to be loaded, whereby the rack teeth of the first support rack and the rack teeth of the second support rack are offset facing one another and cover gaps between teeth in such a way that they establish a common support plane in a assembled state of the first and second support racks.

16. Method according to claim 15, comprising:

after the first loading lane is loaded with plastic receptacles, inserting the second support rack essentially along the support plane into the first support rack, to provide the support function of the first support rack at the first row of loaded plastic receptacles.

17. Method according to claim 16, comprising:

adjusting the first and second support racks vertically, and shifting at least the second support rack at least essentially horizontally and parallel to the first support rack.

18. Method according to claim 17, comprising:

adjusting a predefined distance between the first and second support racks in connection with a movement of the tray in such a way that a loading lane is opened whose width is configured for one-time deposition of one or more rows of plastic containers that are moved up with the multi-gripper.

19. Method according to claim 18, comprising:

depositing two or more layers of plastic receptacles sequentially by the multi-gripper one on top of the other in a loading lane that is bounded by the first and second support racks and side walls of the tray.

20. Method according to claim 15, comprising:

adjusting a predefined distance between the first and second support racks in connection with a movement of the tray in such a way that a loading lane is opened whose width is configured for a one-time deposition of one or more rows of plastic containers that are moved up with the multi-gripper.

* * * * *